US012428116B2

(12) United States Patent
Renfroe et al.

(10) Patent No.: US 12,428,116 B2
(45) Date of Patent: Sep. 30, 2025

(54) LINE-HANDLING IMPROVEMENT AND RETROFIT KIT FOR A SUBMERSIBLE CONVEYANCE

(71) Applicant: The United States of America, as represented by the Secretary of the Navy, San Diego, CA (US)

(72) Inventors: Daniel Troy Renfroe, Temecula, CA (US); Martin John Stacy, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 436 days.

(21) Appl. No.: 18/295,345

(22) Filed: Apr. 4, 2023

(65) Prior Publication Data

US 2024/0336339 A1 Oct. 10, 2024

(51) Int. Cl.
*B63G 8/14* (2006.01)
*B63G 8/00* (2006.01)

(52) U.S. Cl.
CPC ..... *B63G 8/001* (2013.01); *B63G 8/14* (2013.01); *B63G 2008/007* (2013.01)

(58) Field of Classification Search
CPC . B63G 8/00; B63G 8/001; B63G 8/14; B63G 2008/007
USPC ..... 114/331
See application file for complete search history.

(56) References Cited

U.S. PATENT DOCUMENTS 10,502,853 B2 * 12/2019 Thompson ..... B63G 8/001
2023/0026535 A1 * 1/2023 Manning ..... B63G 8/001

OTHER PUBLICATIONS

Mission Specialist Defender, Product Data Sheet, VideoRay LLC. Retrieved from Internet on Apr. 4, 2023: <URL: https://videoray.com/download/76/spec-sheet/18304/2022_spec-sheet_mss_defender>.

* cited by examiner

*Primary Examiner* — Lars A Olson
(74) *Attorney, Agent, or Firm* — Naval Information Warfare Center Pacific; Kyle Eppele

(57) ABSTRACT

A line-handling retrofit kit for improving a submersible conveyance includes a mounting skid, a pair of storage containers, respective pliable caps for the storage containers, a line, and a hook configured to be held in a gripper. A respective pliable cap covers a mouth of each storage container and applies a drag on the line passing through an aperture in the respective pliable cap. The pair of storage containers are symmetrically arranged on the mounting skid with an in-between space. The in-between space aligns with an opening in the mounting skid and enables sensing through both the opening and the in-between space. The line is storable within the storage containers. The line has a first and second end, with the first end affixable to the submersible conveyance or the mounting skid. The hook is affixed to the second end of the line.

20 Claims, 2 Drawing Sheets

LINE-HANDLING IMPROVEMENT AND RETROFIT KIT FOR A SUBMERSIBLE CONVEYANCE

FEDERALLY SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, CA, 92152; voice (619) 553-5118; NIWC_Pacific_T2@us.navy.mil. Reference Navy Case Number 211402.

BACKGROUND OF THE INVENTION

A submersible conveyance can survey target objects on the bottom of a body of water. The submersible conveyance can potentially lift a target object from the bottom of a body of water, but the capabilities of the submersible conveyance may limit the weight of the target object that can be lifted from the bottom of a body of water. There is a general need to increase lifting capacity of a submersible conveyance, while concomitantly achieving safe operation of the submersible conveyance.

SUMMARY OF THE INVENTION

A line-handling retrofit kit for improving a submersible conveyance includes a mounting skid, a pair of storage containers, respective pliable caps for the storage containers, a line, and a hook configured to be held in a gripper. A respective pliable cap covers a mouth of each storage container and applies a drag on the line passing through an aperture in the respective pliable cap. The pair of storage containers are symmetrically arranged on the mounting skid with an in-between space. The in-between space aligns with an opening in the mounting skid and enables sensing through both the opening and the in-between space. The line is storable within the storage containers. The line has a first and second end, with the first end affixable to the submersible conveyance or the mounting skid. The hook is affixed to the second end of the line.

BRIEF DESCRIPTION OF DRAWINGS

Throughout the several views, like elements are referenced using like references. The elements in the figures are not drawn to scale and some dimensions are exaggerated for clarity.

DETAILED DESCRIPTION

Figure 1:
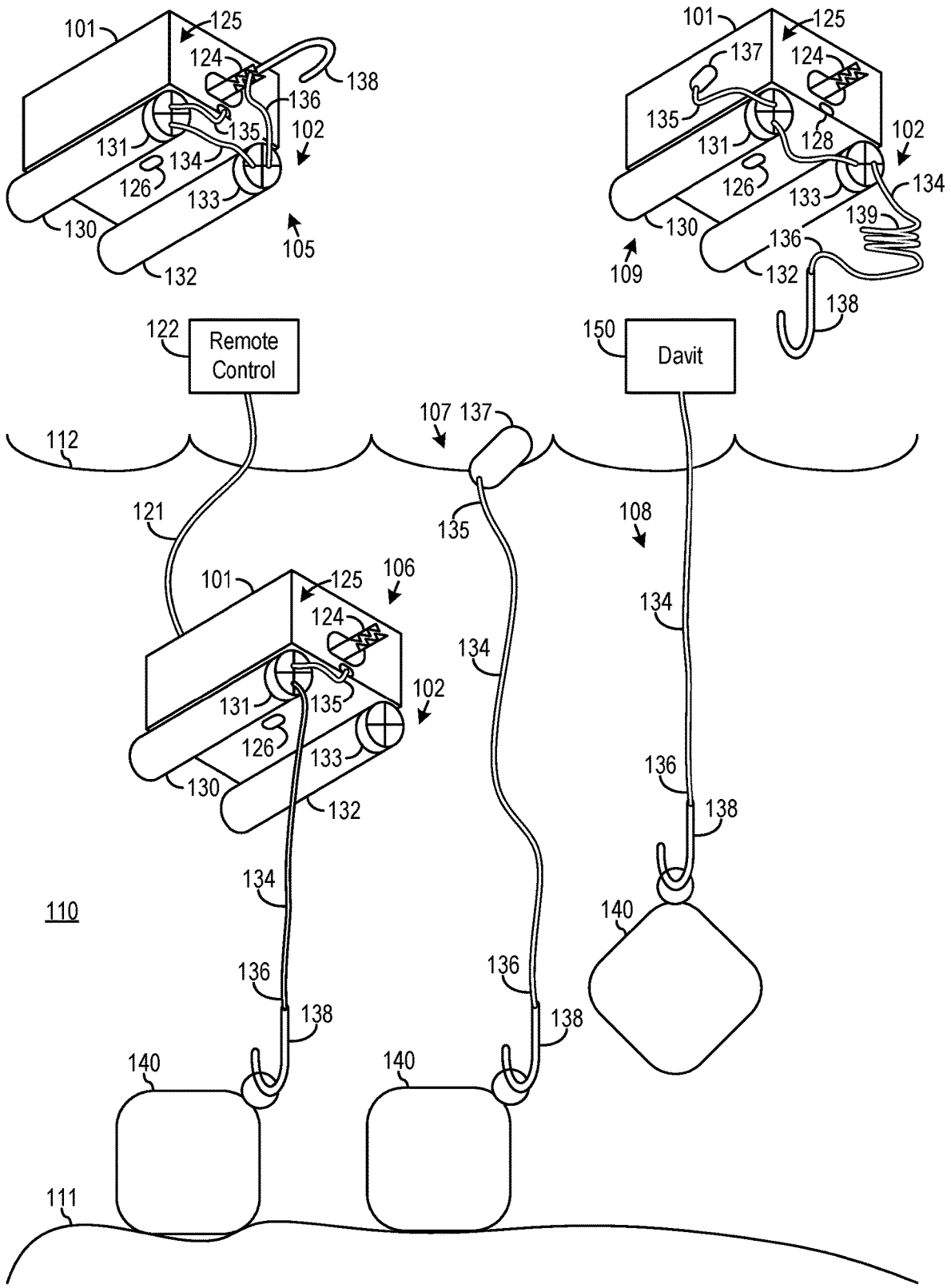
FIG. 1 is a perspective view of various states of an improvement to a submersible conveyance that is remotely operated in accordance with an embodiment of the invention.

The disclosed systems and methods below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other systems and methods described herein as will be understood by one of ordinary skill in the art unless otherwise stated specifically.

While testing and evaluating the DEFENDER™ underwater remotely-operated vehicle available from VIDEORAY™, the inventors noticed several functional limitations of the DEFENDER™ underwater remotely-operated vehicle. Based upon this experience, the inventors discovered that a retrofit kit for the DEFENDER™ vehicle could safely maneuver the DEFENDER™ vehicle closer to the seafloor, while maintaining bottom lock with the onboard velocity maintainer, which is denoted the Digital Velocity Logger (DVL) by VIDEORAY™. The inventors further discovered that the retrofit kit could improve line handling by increasing the lifting capability beyond the limited grasping ability of the onboard gripper, while eliminating overstressing of the control tether of the DEFENDER™ vehicle and nearly eliminating the possibility of the line becoming entangled with the control tether or the thrusters of the DEFENDER™ vehicle.

Testing and evaluation of a prototype line-handling improvement demonstrated that repositioning the main gripper six inches lower and six inches forward brought the gripper into optimal view of the remote operator, while bringing the bottom of the body of water into the focal range of the DVL even when operating the gripper at the bottom of the body of water. The prototype line-handling improvement is small, compact, and easily transported during shipment and easily deployed on small boats. In addition, the existing cam lock mounting points of the DEFENDER™ vehicle can be used to attach the prototype retrofit kit to the DEFENDER™ vehicle. The prototype retrofit kit was demonstrated during testing and evaluation to perform as designed and functioned flawlessly in various difficult sea conditions.

In addition, not only is functionality improved, but safety is improved in and out of the water and while on the deck of small boats. By ensuring, the improved DEFENDER™ vehicle maintains bottom lock from repositioning the main gripper, the improved DEFENDER™ vehicle is able to navigate across the seafloor and recover target objection with greater ease and control, and without incurring the detrimental loss of control when the DVL loses bottom lock. Thereby, the main gripper and camera dome avoid damage from impacts with the seafloor. In addition, line entanglement with the DEFENDER™ vehicle's thrusters is significantly mitigated, dramatically reducing the possibility of the DEFENDER™ vehicle becoming trapped on the seafloor, adding confidence to the mission's success. The prototype line recovery line-handling improvement was shown to be easily mounted on the DEFENDER™ vehicle and to perform safely in a demanding war space environment.

In summary, the prototype line-handling improvement to the DEFENDER™ vehicle provides easy attachment to the DEFENDER™ vehicle while improving bottom lock and line handling in the demanding war space environment.

FIG. 1 is a perspective view of various states 105, 106, 107, 108, and 109 of an improvement to a submersible conveyance 101 that is remotely operated in accordance with an embodiment of the invention. In one embodiment, a submersible conveyance 101 is improved with a line-handling retrofit kit 102. The line-handling improvement of the retrofit kit 102 includes a pair of storage containers 130 and 132 with respective pliable caps 131 and 133, a line 134, and a hook 138.

The submersible conveyance 101 is remotely operated for commanded motion in any direction within a body of water 110 surrounding the submersible conveyance 101. The submersible conveyance 101 is remotely operated either wirelessly or with a wired tether 121 that controls the submersible conveyance 101 from a remote control console 122. The submersible conveyance 101 is remotely operated to open and close a gripper 124 affixed to the submersible conveyance 101. The submersible conveyance 101 is remotely operated to engage a velocity maintainer 126 that, within a range of a bottom 111 of the body of water 110, senses the bottom 111 and locks the commanded motion relative to the bottom 111 despite fluctuating currents in the body of water 110. For example, when the commanded velocity is zero velocity, the velocity maintainer 126 works with its inertial measurement unit to hoover the submersible conveyance 101 over a fixed point on the bottom 111 despite a back-and-forth swaying undertow in the body of water 110 caused by waves breaking on a nearby or distant shoreline.

The pair of storage containers 130 and 132 are symmetrically arranged on an underside of the submersible conveyance 101 with an in-between space. The velocity maintainer 126 senses the bottom 111 of the body of water 110 through the space between the storage containers 130 and 132. Thus, the symmetrical arrangement of the storage containers 130 and 132 balances equilibrium without blocking the view of the velocity maintainer 126. A respective pliable cap 131 or 133 covers a mouth of each of the storage containers 130 and 132. The respective pliable caps 131 and 133 apply a slight drag on the line 134 upon the line 134 passing through an aperture in the respective pliable caps 131 and 133.

The line 134 is storable within the storage containers 130 and 132. The line 134 has a first end 135 affixable to the submersible conveyance 101. The hook 138 is affixed to the second end 136 of the line 134. The hook 138 is configured to be held in the gripper 124 when the gripper 124 is closed.

In one embodiment, the storage containers 130 and 132 arranged on the underside of the submersible conveyance 101 are elongated and oriented with the mouth of each of the storage containers 130 and 132 facing a tool side 125 of the submersible conveyance 101. The gripper 124 projects from the tool side 125.

In a deploying state 105, the line 134 is stored in the storage containers 130 and 132. The line 134 runs sequentially from the first end 135 affixed to the submersible conveyance 101, then into and out of the aperture in the respective pliable cap 131 of a first storage container 130, then into and out of the aperture in the respective pliable cap 133 of a second storage container 132, and finally to the second end 136 of the line 134. The hook 138 affixed to the second end 136 is held in the closed gripper 124.

In a returning state 106 following the deploying state 105, the hook 138 is hooked onto a target object 140 at the bottom 111 of the body of water 110, and the hook 138 affixed to the second end 136 of the line 134 is no longer held in the gripper 124. At least a portion of the line 134 is no longer stored in the storage containers 130 and 132. This portion of the line 134 runs under the slight drag from the respective pliable cap 131 or 133 of either one of the storage containers 130 and 132 to the second end 136 of the line 134 having the hook 138 affixed and the target object 140 hooked. For example, as shown in FIG. 1 for the returning state 106, the line 134 has emptied from storage container 132, but storage container 130 is still dispensing the line 134.

In a retrieving state 108 following the returning state 106, the portion of the line 134 and the hook 138 lift the target object 140 from the bottom 111 of the body of water 110 to a top surface 112 of the body of water 110. In one embodiment, the line-handling improvement of the retrofit kit 102 further includes a buoy 137 affixed to the first end 135 of the line 134. The first end 135 of the line 134 is initially affixed to the submersible conveyance 101 with a clasp 128. In an optional awaiting state 107 after the returning state 106 and before the retrieving state 108, the submersible conveyance 101 is remotely operated to release the clasp 128 so that the line 134 dangles from the buoy 137 in the body of water 110.

In example operation, the submersible conveyance 101 is prepared in the deploying state 105 above the top surface 112 of the body of water 110 with the hook 138 held in the closed gripper 124. The submersible conveyance 101 is deployed into the body of water 110, and remotely operated to maneuver the submersible conveyance 101 to the target object 140. Then, the submersible conveyance 101 is remotely operated to secure the hook 138 onto the target object 140. This might involve, for example, rotating the gripper 124 so the hook 138 rotates into an appropriate orientation for engaging the target object 140. The gripper 124 is remotely opened to release the hook 138 from the gripper 124. Next, the submersible conveyance 101 is remotely operated to ascend to the top surface 112 of the body of water 110, while an operator reels up the slack in the wired tether 121 and potentially lifts the submersible conveyance 101 with the wired tether 121. As the submersible conveyance 101 ascends, the line 134 is dispensed from storage container 132 with slight drag applied by the respective pliable cap 133. If the line 134 stored in the storage container 132 gets dispensed completely as shown in returning state 106, then the line 134 starts dispensing from storage container 130 with slight drag applied by the respective pliable cap 131. Entanglement of the wired tether 121 and the line 134 is prevented because the wired tether 121 and the line 134 extend under tension from opposite sides of the submersible conveyance 101. Entanglement is especially prevented when the submersible conveyance 101 ascends vertically with the tool side 125 facing the target object 140 at the bottom 111 of the body of water 110.

In the prototype embodiment, the line-handling retrofit kit 102 is equipped with 600 feet of quarter-inch Amsteel™ Yellow line 134 stuffed into the cylindrical canisters 221 and 223, which are two PVC tubes having a four inch diameter. Increasing the width of the line 134 to ⅜ inch of Amsteel™ Yellow line 134 decreases the depth from which the target object 140 can be lifted, but increases the lifting weight for the target object 140. Further increasing the width of the line 134 to half-inch of Amsteel™ Yellow line 134 further decreases the depth from which the target object 140 can be lifted, but further increases the lifting weight for the target object 140.

Upon the submersible conveyance 101 reaching the top surface 112 of the body of water 110, either the line 134 is immediately hauled by hand or davit 150 in the retrieving state 108, or the clasp 128 is released to achieve the awaiting state 107. In one example, the retrofit kit 102 includes multiple lines like line 134, each with a respective hook 138 and respective buoy 137, and multiple target objects like target object 140 are captured with the respective hook 138 and the respective buoy 137 before any target objects are lifted from the body of water 110. In another example, the target object 140 is large and has slightly negative buoyancy, so the line 134 has sufficient strength to lift the target object 140 from the bottom 111 to the top surface 112, but not enough strength to lift the target object 140 out of the body of water 110. Before lifting the target object 140 from the bottom 111, the clasp 128 is released with the attached buoy 137 preventing loss of the first end 135 of the line 134. In one embodiment, the release of the clasp 128 automatically inflates a collapsed buoy 137 attached to the first end 135 of the line 134 in the deploying state 105 (collapsed buoy 137 and reference number for clasp 128 shown in redeploying state 109). After lifting the target object 140 from the bottom 111 to the top surface 112 with the line 134 in the retrieving state 108, stronger lines (not shown) are attached to the target object 140 for lifting the target object 140 out of the body of water 110 with davit 150.

In a redeploying state 109 following the retrieving state 108, the submersible conveyance 101 and the line-handling retrofit kit 102 are partially prepared for the retrieval of another target object. The line 134 or another line in the retrofit kit 102 has been stored in the storage containers 130 and 132, except for a final hank 139 of the line 134 being stuffed into the storage containers 130 and 132. In one embodiment, the mouth and the aperture for each of the storage containers 130 and 132 are dimensioned to accept a hand of a human operator successively grasping each hank 139 of the line and pushing each hank 139 into the storage containers 130 and 132 through the aperture at the mouth of the storage containers 130 and 132. To complete redeployment and again achieve the deploying state 105 after storing hank 139, the first end 135 of the line 134 line is affixed to the clasp 128 and the gripper 124 is closed on the hook 138.

Figure 2:
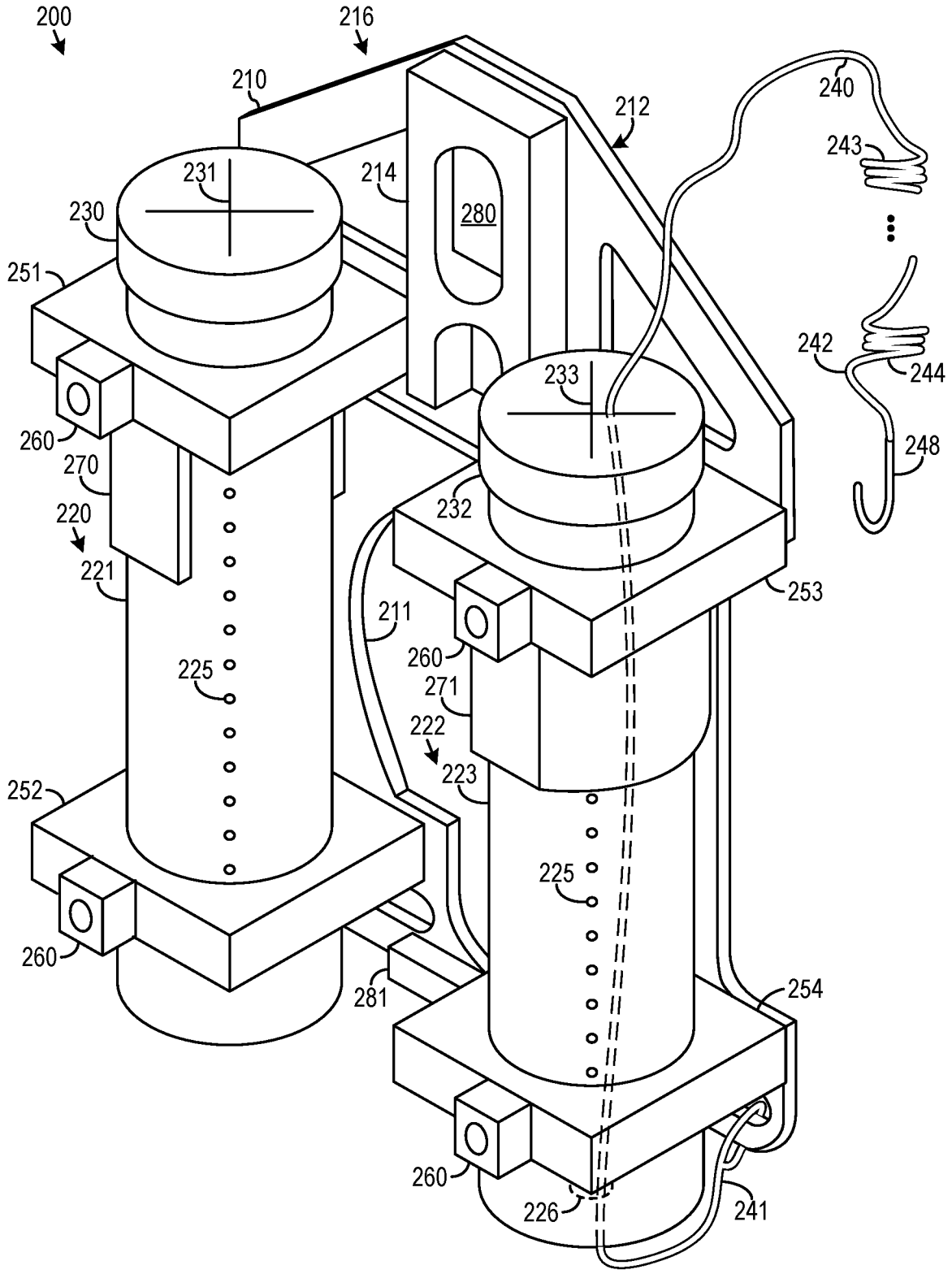
FIG. 2 is a perspective view of a line-handling retrofit kit for enhancing a remotely-operated submersible conveyance in accordance with an embodiment of the invention.

FIG. 2 is a perspective view of a line-handling retrofit kit 200 for enhancing a remotely-operated submersible conveyance in accordance with an embodiment of the invention. The retrofit kit 200 includes a mounting skid 210, a pair of elongated storage containers 220 and 222, and respective pliable caps 230 and 232 covering a mouth of the elongated storage containers 220 and 222. The retrofit kit 200 preferably includes the mounting skid 210, but the mounting skid 210 could be omitted in one embodiment of the invention. We call the retrofit kit 200 the MARDAN line-handling system.

The mounting skid 210 has an opening 211. The pair of elongated storage containers 220 and 222 are symmetrically arranged on the mounting skid 210 with an in-between space, which is aligned with the opening 211 in the mounting skid 210 and enables the submersible conveyance's sensing through both the opening 211 and the space between the elongated storage containers 220 and 222. The elongated storage containers 220 and 222 are oriented with the mouth of each of the elongated storage containers 220 and 222 facing a tool side 216 from which projects the gripper (not shown).

The line 240 is storable within the elongated storage containers 220 and 222. The respective pliable caps 230 and 232 apply a slight drag on the line 240 upon the line 240 passing through an aperture 231 or 233 in each of the respective pliable caps 230 and 232. The line 240 has a first end 241 and a second end 242. The first end 241 is affixed to the mounting skid 210. In one embodiment, the first end 241 of the line 240 is pushed through the pliable cap 233 to the bottom of the elongated storage container 222 and then through a hole 226 in the bottom of the elongated storage container. Next, the first end 241 of the line 240 is affixed to the mounting skid 210. In another embodiment, the first end 241 is affixed to the mounting skid 210 because the first end 241 is affixed to the submersible conveyance as shown in FIG. 1 and the submersible conveyance is affixed to the mounting skid 210. The hook 248 is affixed to the second end 242 of the line 240.

In one embodiment, the elongated storage containers 220 and 222 include a pair of cylindrical canisters 221 and 223. The elongated storage containers 220 and 222 further include a square mounting block 251, 252, 253, or 254 at each end of each of the cylindrical canisters 221 and 223 for fastening the cylindrical canisters 221 and 223 to the underside of the submersible conveyance via cam lock projections 260. The cam lock projections 260 match cam lock sockets existing on the submersible conveyance before the improvement of installing the line-handling retrofit kit 200. In this embodiment, the respective pliable cap 230 or 232 for each of the elongated storage containers 220 and 222 covers the mouth, which is a circular mouth, of a respective one of the cylindrical canisters 221 and 223.

When the cam lock projections 260 fasten the cylindrical canisters 221 and 223 to the underside of the submersible conveyance, the elongated storage containers 220 and 222 become sandwiched between the underside of the submersible conveyance and the mounting skid 210. In addition, the flat underside 212 of the mounting skid 210 becomes approximately parallel to the underside of the submersible conveyance. Thus, the mounting skid 210 protects the elongated storage containers 220 and 222 and the submersible conveyance whenever the flat underside 212 of the mounting skid 210 rests on the deck of a maritime vehicle, or during any unfortunate impact with the bottom of the body of water.

The aperture 231 or 233 of the respective pliable cap 230 or 232 for each of the elongated storage containers 220 and 222 is at least one slit having respective flaps on both sides of the slit for applying the slight drag on the line 240 upon the line 240 passing through the slit while squeezed between the respective flaps. The mouth and the slit or slits for each of the elongated storage containers 220 and 222 are dimensioned to accept a hand of a human operator successively grasping each hank 243 through 244 of the line 240 being stuffed into the elongated storage containers 220 and 222. After half of the line 240 is stuffed into the elongated storage container 222 and the other half of the line 240 is stuffed into the elongated storage container 220, it is recommended to place a strip of adhesive tape over the apertures 231 and 233 and where the line 240 passes between the pliable caps 230 and 232.

In one embodiment, the elongated storage containers 220 and 222 include cylindrical canisters 221 and 223 perforated with perforations 225 for flooding and de-watering the perforated storage containers 220 and 222 from the body of water.

In one embodiment, the gripper is repositioned from near the underside of the submersible conveyance to the mounting skid 210 without disconnecting an electrical cable between the submersible conveyance and the gripper. The electrical cable provides control for opening and closing the gripper. Because the electrical cable is not disconnected, the required skill is diminished for the operator of the improved submersible conveyance. The gripper mount 214 accepts the same hardware used to mount the gripper onto the submersible conveyance. Thus, for example, the same four hex head cap bolts and spacers used to mount the gripper onto the submersible conveyance are used to mount the gripper to the gripper mount 214. This eliminates the need for additional mounting hardware and provides continuity within the mounting hardware. The gripper and the gripper mount 214 are disposed on the same side of the mounting skid 210. Thus, the mounting skid 210 also protects the gripper while the flat underside 212 of the mounting skid 210 rests on the deck of a maritime vehicle, or during any unfortunate impact with the bottom of the body of water.

In one embodiment, the gripper is repositioned onto the gripper mount 214 not only away from the underside of the submersible conveyance, but also is repositioned to project out farther from the tool side 216 of the submersible conveyance. The extra distance between the gripper and the underside of the submersible conveyance helps the velocity maintainer focus on the bottom of the body of water when the submersible conveyance approaches a target objection resting on the bottom of the body of water and stirs up interfering debris from the bottom of the body of water. The extra distance projecting out from the tool side 216 of the submersible conveyance helps bring the gripper into optimal view of a gimbaled camera within an observation dome mounted on the tool side 216 of the submersible conveyance.

In one embodiment, non-compressible foam collars 270 and 271 are affixed to the elongated storage containers 220 and 222. The non-compressible foam collars 270 and 271 provide buoyancy offsetting the submerged weight of the line-handling retrofit kit 200. The non-compressible foam collars 270 and 271 are mounted toward the tool side 216 of the line-handling retrofit kit 200 to balance the moment about the center of buoyancy caused by repositioning the gripper onto the gripper mount 214. Adjustable ballast weights 280 and 281 affixed to the mounting skid 210 fine tune the buoyancy. For example, when the gripper is not repositioned from the submersible conveyance, moving most of the ballast weights 281 into ballast weights 280 achieves neutral attitude of the submersible conveyance improved with the line-handling retrofit kit 200. Collectively, the non-compressible foam collars 270 and 271 and the adjustable ballast weights 280 and 281 achieve near neutral buoyancy and neutral attitude of the improved submersible conveyance. In particular, the improved submersible conveyance rests motionless in a still body of water when the thrusters are deactivated on the submersible conveyance, and the improved submersible conveyance rests oriented with the tool side 216 tilted at an operator-selected angle toward the bottom of the still body of water.

From the above description of a Line-Handling Improvement and Retrofit Kit for a Submersible Conveyance, it is manifest that various techniques may be used for implementing the concepts of the improvement and retrofit kit 102 and 200 without departing from the scope of the claims. The described embodiments are to be considered in all respects as illustrative and not restrictive. Each of the improvement and retrofit kit 102 or 200 disclosed herein may be practiced in the absence of any element that is not specifically claimed and/or disclosed herein. It should also be understood that each of the improvement and retrofit kit 102 or 200 is not limited to the particular embodiments described herein, but is capable of many embodiments without departing from the scope of the claims.

We claim:

1. An improvement to a submersible conveyance that is remotely operated for commanded motion in any direction within a body of water surrounding the submersible conveyance, is remotely operated to open and close a gripper affixed to the submersible conveyance, and is remotely operated to engage a velocity maintainer that, within a range of a bottom of the body of water, senses the bottom and locks the commanded motion relative to the bottom despite fluctuating currents in the body of water, wherein the improvement is a line-handling improvement comprising:

a pair of storage containers symmetrically arranged on an underside of the submersible conveyance with an in-between space, the velocity maintainer sensing the bottom of the body of water through the space between the storage containers;

a line storable within the storage containers, the line having a first and second end, with the first end affixable to the submersible conveyance;

a hook affixed to the second end of the line, the hook configured to be held in the gripper when the gripper is closed; and a respective pliable cap covering a mouth of each of the storage containers, the respective pliable cap for applying a drag on the line upon the line passing through an aperture in the respective pliable cap.

2. The improvement to the submersible conveyance of claim 1, wherein in a deploying state:

the line is stored in the storage containers with the line running sequentially from the first end affixed to the submersible conveyance, then into and out of the aperture in the respective pliable cap of a first one of the storage containers, then into and out of the aperture in the respective pliable cap of a second one of the storage containers, and finally to the second end of the line; and the hook affixed to the second end is held in the gripper that is closed.

3. The improvement to the submersible conveyance of claim 2, wherein in a returning state following the deploying state:

the hook is hooked onto a target object at the bottom of the body of water, and the hook affixed to the second end of the line is no longer held in the gripper; and at least a portion of the line is no longer stored in the storage containers, with the portion of the line running under the drag from the respective pliable cap of either one of the storage containers to the second end of the line having the hook affixed and the target object hooked.

4. The improvement to the submersible conveyance of claim 3, wherein in a retrieving state following the returning state:

the portion of the line and the hook lift the target object from the bottom of the body of water to a top surface of the body of water.

5. The improvement to the submersible conveyance of claim 1, wherein the storage containers arranged on the underside of the submersible conveyance are elongated and oriented with the mouth of each of the storage containers facing a tool side of the submersible conveyance from which projects the gripper.

6. The improvement to the submersible conveyance of claim 1, wherein the storage containers are perforated storage containers for flooding and de-watering the perforated storage containers from the body of water.

7. The improvement to the submersible conveyance of claim 1, wherein:

the storage containers include a pair of cylindrical canisters and the storage containers further include a square mounting block at each end of each of the cylindrical canisters for fastening the cylindrical canisters to the underside of the submersible conveyance via cam lock projections matching cam lock sockets existing on the submersible conveyance before the improvement; and the respective pliable cap for each of the storage containers covers the mouth, which is a circular mouth, of a respective one of the cylindrical canisters.

8. The improvement to the submersible conveyance of claim 1, wherein the aperture of the respective pliable cap for each of the storage containers is at least one slit having respective flaps on both sides of the slit for applying the drag on the line upon the line passing through the slit while squeezed between the respective flaps.

9. The improvement to the submersible conveyance of claim 1, wherein:

the aperture of the respective pliable cap for each of the storage containers is at least one slit having respective flaps on both sides of the slit; and the mouth and said at least one slit for each of the storage containers are dimensioned to accept a hand of a human operator successively grasping each of a plurality of hanks of the line being stuffed into the storage containers.

10. The improvement to the submersible conveyance of claim 1, the improvement further comprising a mounting skid having an opening with the velocity maintainer sensing the bottom of the body of water through both the opening and the space between the storage containers, the storage containers sandwiched between the underside of the submersible conveyance and the mounting skid.

11. The improvement to the submersible conveyance of claim 10, wherein the gripper is repositioned from near the underside of the submersible conveyance to the mounting skid affixed to the submersible conveyance without disconnecting at least one electrical cable between the submersible conveyance and the gripper, said at least one electrical cable for opening and closing the gripper.

12. The improvement to the submersible conveyance of claim 11, wherein the gripper is repositioned not only away from the underside of the submersible conveyance, but also repositioned to project out farther from a tool side of the submersible conveyance.

13. The improvement to the submersible conveyance of claim 11, wherein an underside of the mounting skid is flat and approximately parallel to the underside of the submersible conveyance.

14. The improvement to the submersible conveyance of claim 10, the improvement further comprising non-compressible foam collars affixed to the storage containers and adjustable ballast weights affixed to the mounting skid for collectively achieving near neutral buoyancy and neutral attitude of the submersible conveyance having the improvement.

15. The improvement to the submersible conveyance of claim 1, the improvement further comprising:

a buoy affixed to the first end of the line, wherein the first end of the line is affixed to the submersible conveyance with a clasp and the submersible conveyance is remotely operated to release the clasp so that the line dangles from the buoy in the body of water.

16. A line-handling retrofit kit for enhancing a submersible conveyance that is remotely operated, wherein the retrofit kit comprises:

a mounting skid having an opening;

a pair of elongated storage containers symmetrically arranged on the mounting skid with an in-between space, which is aligned with the opening in the mounting skid and enables sensing through both the opening and the space between the elongated storage containers;

a line storable within the elongated storage containers, the line having a first and second end, with the first end affixed to the mounting skid;

a hook affixed to the second end of the line; and a respective pliable cap covering a mouth of each of the elongated storage containers, the respective pliable cap for applying a drag on the line upon the line passing through an aperture in the respective pliable cap.

17. The line-handling retrofit kit of claim 16, wherein, in a deploying state:

the line is stored in the elongated storage containers with the line running sequentially from the first end affixed to the mounting skid, then into and out of the aperture in the respective pliable cap of a first one of the elongated storage containers, then into and out of the aperture in the respective pliable cap of a second one of the elongated storage containers, and finally to the second end of the line having the hook affixed;

in a returning state following the deploying state:

the hook affixed to the second end of the line is hooked onto a target object at the bottom of the body of water; and at least a portion of the line is no longer stored in the elongated storage containers, with the portion of the line running under the drag from the respective pliable cap of either one of the elongated storage containers to the second end of the line having the hook affixed and the target object hooked; and in a retrieving state following the returning state:

the portion of the line and the hook hooked onto the target object lift the target object from the bottom of the body of water to a top surface of the body of water.

18. The line-handling retrofit kit of claim 16, further comprising:

the gripper repositioned from the submersible conveyance to the mounting skid without disconnecting at least one electrical cable for opening and closing the gripper, wherein the hook is configured to be held in the gripper when the gripper is closed, and wherein the elongated storage containers arranged on the mounting skid are perforated and oriented with the mouth of each of the elongated storage containers facing a tool side from which projects the gripper.

19. The line-handling retrofit kit of claim 16, wherein:

the elongated storage containers include a pair of cylindrical canisters and the elongated storage containers further include a square mounting block at each end of each of the cylindrical canisters for fastening the cylindrical canisters to an underside of the submersible conveyance via a cam lock; and the respective pliable cap for each of the elongated storage containers covers the mouth, which is a circular mouth, of a respective one of the cylindrical canisters.

20. The line-handling retrofit kit of claim 16, wherein the aperture of the respective pliable cap for each of the elongated storage containers is at least one slit having respective flaps on both sides of the slit for applying the drag on the line upon the line passing through the slit while squeezed between the respective flaps; and the mouth and said at least one slit of each for the elongated storage containers are dimensioned to accept a hand of a human operator successively grasping each of a plurality of hanks of the line being stuffed into the elongated storage containers.

* * * * *